US005327961A

United States Patent [19]

Mills

[11] Patent Number: 5,327,961

[45] Date of Patent: Jul. 12, 1994

[54] DRIVE HEAD FOR DOWNHOLE ROTARY PUMP

[76] Inventor: Robert A. R. Mills, 8903 Baylor Cr. SW, Calgary AB, T2V 3N5, Canada

[21] Appl. No.: 950,959

[22] Filed: Sep. 25, 1992

[51] Int. Cl.[5] ..... F04B 47/04

[52] U.S. Cl. ..... 166/68.5; 166/78

[58] Field of Search ..... 166/68.5, 78

[56] References Cited

U.S. PATENT DOCUMENTS

| | | | |
|---|---|---|---|
| 2,471,198 | 5/1949 | Cormany . | |
| 2,739,790 | 3/1956 | Ball . | |
| 3,128,614 | 4/1964 | Auer . | |
| 3,891,031 | 6/1975 | Ortiz . | |
| 4,087,211 | 5/1978 | Pochyly . | |
| 4,089,624 | 5/1978 | Nichols et al. . | |
| 4,314,611 | 2/1982 | Willis . | |
| 4,372,379 | 2/1983 | Kulhanek et al. . | |
| 4,480,685 | 11/1984 | Gilbertson | 166/68.5 |

*Primary Examiner*—William P. Neuder

*Attorney, Agent, or Firm*—Varnum, Riddering, Schmidt & Howlett

[57] ABSTRACT

A drive head for a downhole rotary pump operated by a drive string rotatable in a production string includes a hollow rotatable drive shaft having an axial bore for a polished rod, a housing attachable to a wellhead assembly, radial bearings centering the drive shaft in the housing and one axial thrust bearing to support the weight of the drive shaft and the drive string suspended therefrom. A pulley mounted on the shaft for the driving of the drive shaft, which includes a chuck arrangement for the concentrical clamping of the polished rod in the drive shaft. The drive head is used in combination with a polished rod clamp which is affixed to the polished rod for the suspending of the weight of the drive string and rests on top of the chuck arrangement. This construction substantially prevents polished rod wobble and the associated stuffing box leakage as well as accidental downward slippage of the drive string which could lead to serious damage of the downhole pump.

17 Claims, 4 Drawing Sheets

DRIVE HEAD FOR DOWNHOLE ROTARY PUMP

FIELD OF THE INVENTION

The invention relates to downhole rotary pump systems and more particularly to drive heads for rotary downhole pumps.

BACKGROUND OF THE INVENTION

Downhole rotary pumps, such as progressing cavity pumps, are used for the conveying of different types of liquids, but are especially well suited for the pumping of very viscous or thick liquids such as crude oil admixed with a large portion of sand. A downhole rotary pump is driven by a drive string, generally consistent of a rod or tube string having a polished rod at its upper end. The drive string rotates in a stationary production string and is suspended from, and rotated by a drive head assembly associated with the wellhead. The drive head assembly must be able to suspend the weight of the drive string which can become quite substantial for deep wells, while allowing it to be rotated in the production string. Furthermore, the drive head must include a structure permitting the transmission of sufficient torque to the drive string for the pumping of thick liquids.

A drive head assembly for use with rotary downhole pumps is disclosed in U.S. Pat. No. 4,372,379 by Kulhanek et al. The assembly includes a hollow spindle through which the drive string may extend, a frame supporting the spindle on a wellhead and a sprocket connected with a motor for rotation of the spindle. The drive string is suspended from the spindle by a polished rod clamp which rests on top of the spindle. The polished rod is of rectangular shape and is received in a complementary recess in the top end of the spindle. This dog clutch arrangement permits the transmission of torque from the spindle to the drive string. Although this drive head arrangement performs the desired functions of suspending and rotating the drive string, there are certain problems associated with its operation. The polished rod clamp, which is designed to hold but not rotate a drive string, may slip on the polished rod at high torque. As a result, the drive string may slide down through the spindle, which may lead to serious damage of the downhole pump. Furthermore, the drive string cannot be exactly centered in the spindle, since the bore of the spindle must be sufficiently larger than the polished rod diameter to permit insertion of the polished rod in the field and the fit of the rectangular polished rod clamp in the recess of the spindle generally cannot be made close enough to avoid radial movement of the clamp in the recess. However, insufficient centering of the polished rod results in polished rod wobble which is the principle cause of stuffing box leakage and has been a persistent problem for the industry.

Thus, a drive head assembly is desired which substantially prevents polished rod wobble and drive string slippage.

SUMMARY OF THE INVENTION

It is an object of the invention to provide a drive head for a rotary downhole pump which substantially prevents polished rod wobble.

It is another object of the invention to provide a rotary drive assembly for a downhole rotary pump that substantially prevents accidental polish rod slippage, which may result in downhole pump damage.

It is yet another object of the invention to provide a drive head which includes a rotary drive shaft and a means for centering a portion of the drive string in the drive shaft.

It is still a further object of the invention to provide a drive head which includes a clamping means for concentrically clamping a polished rod in the drive shaft to permit a transmission of torque from the drive shaft to the drive string.

Accordingly, the invention provides a drive head for a downhole rotary pump operated by a drive string rotatable in a production string, which drive head includes a hollow rotatable drive shaft having an axis and an axial bore for receiving a portion of the drive string, the bore connecting first and second openings in the ends of the drive shaft, mount means for rotatably supporting the drive shaft on and coaxial with a wellhead assembly, the drive shaft being rotatable around the axis, drive means for rotating the drive shaft relative to the mount means, means for transmitting torque from the drive shaft to the drive string, and means for centering the portion of the drive string in the drive shaft.

In a preferred embodiment, the means for transmitting torque and the means for centering are combined in a clamping means integral with the drive shaft for concentrically clamping the drive string in the drive shaft to permit transmission of torque from the drive shaft to the drive string.

The mount means preferably includes a housing attachable to the wellhead assembly and a bearing means for rotatably supporting the drive shaft in the housing. The clamping means is preferably a chuck arrangement for concentrically clamping the portion of the drive string in the drive shaft.

In a preferred embodiment, the chuck arrangement is integral with a portion of the drive shaft, which portion has a frustoconical bore. The chuck arrangement includes spline means for gripping the portion of the drive string. The spline means has an outer frustoconical surface complementary in slope to the frustoconical bore of the portion of the shaft and defines an axial bore for receiving the drive string. The chuck arrangement further includes a means for axially forcing the spline means into the frustoconical bore, whereby the spline means is radially inwardly forced against the portion of the drive string extending through the spline means for clamping the drive string.

The chuck arrangement is preferably integral with an end portion of the shaft remote from the wellhead.

The means for forcing is preferably a cap having a bore for the drive string, which bore includes a threaded portion for engaging an outer thread on the end portion of the drive shaft, and an annular shoulder for resting against an outer annular shoulder on the spline means, whereby the spline means is forced into the frustoconical bore, when the cap is screwed onto the end portion.

In another aspect, the invention provides a rotary drive assembly for a rotary downhole pump operated by a drive string rotatable in a production string, which assembly includes a drive head as defined above for rotating the drive string and the production string and means for suspending the weight of the drive string from the drive head. The means for suspending is preferably a polished rod clamp resting on the drive shaft.

DETAILED DESCRIPTION OF THE PREFERRED EMBODIMENTS

The invention will now be further described by way of example only and with reference to the following drawings, wherein FIG. 1 is a schematic side elevation of a downhole pump arrangement including a drive head in accordance with the invention;

Figure 1:
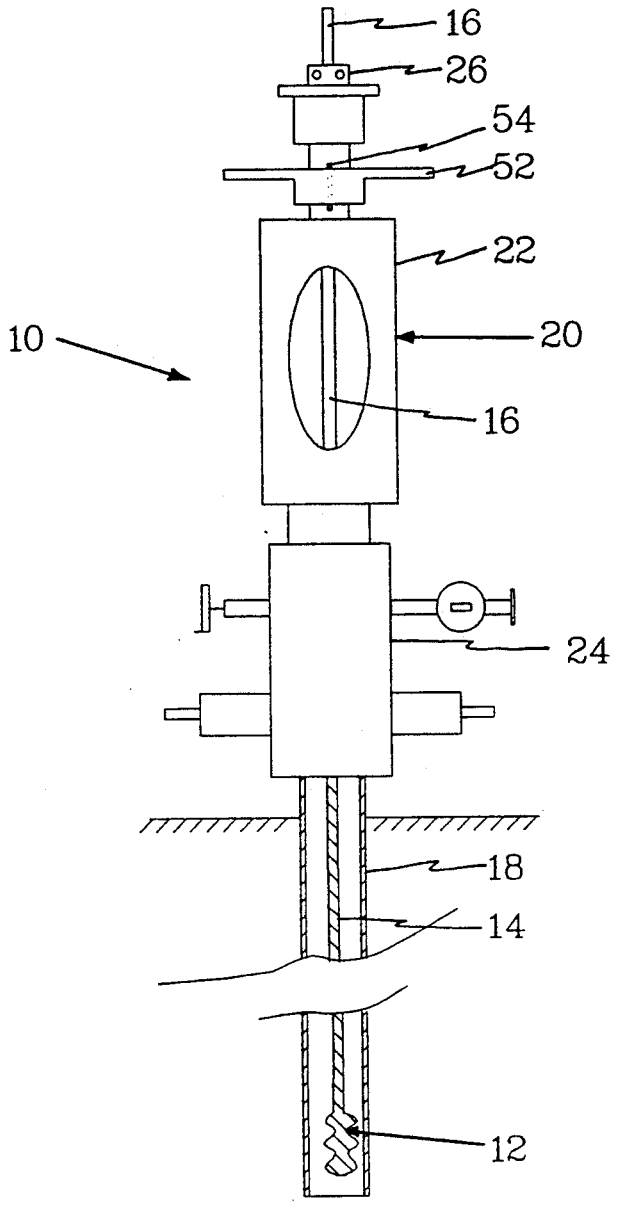

A preferred embodiment of a rotary drive assembly 10 in accordance with the invention as shown in FIG. 1 is generally used in combination with a rotary downhole pump 12 operated by a drive string 14 which has at its upper end a polished rod 16 and is rotatable in a production string 18. The rotatable drive assembly 10 generally includes a drive head 20 which will be described in more detail further below with reference to FIG. 2. The drive head 20 has a housing 22 which can be screwed to the top end of a wellhead assembly 24. The drive string 14 is suspended from the drive head 20 by way of a conventional polished rod clamp 26 which is fastened to the polished rod 16 and rests on top of the drive head 20. A pulley 52 is mounted to the upper end 44 of the drive shaft 28 and is locked thereon by a key 54. The drive shaft may be rotated by a motor (not shown) connected to the pulley 52 through a V-belt for torque transmission.

Figure 2:
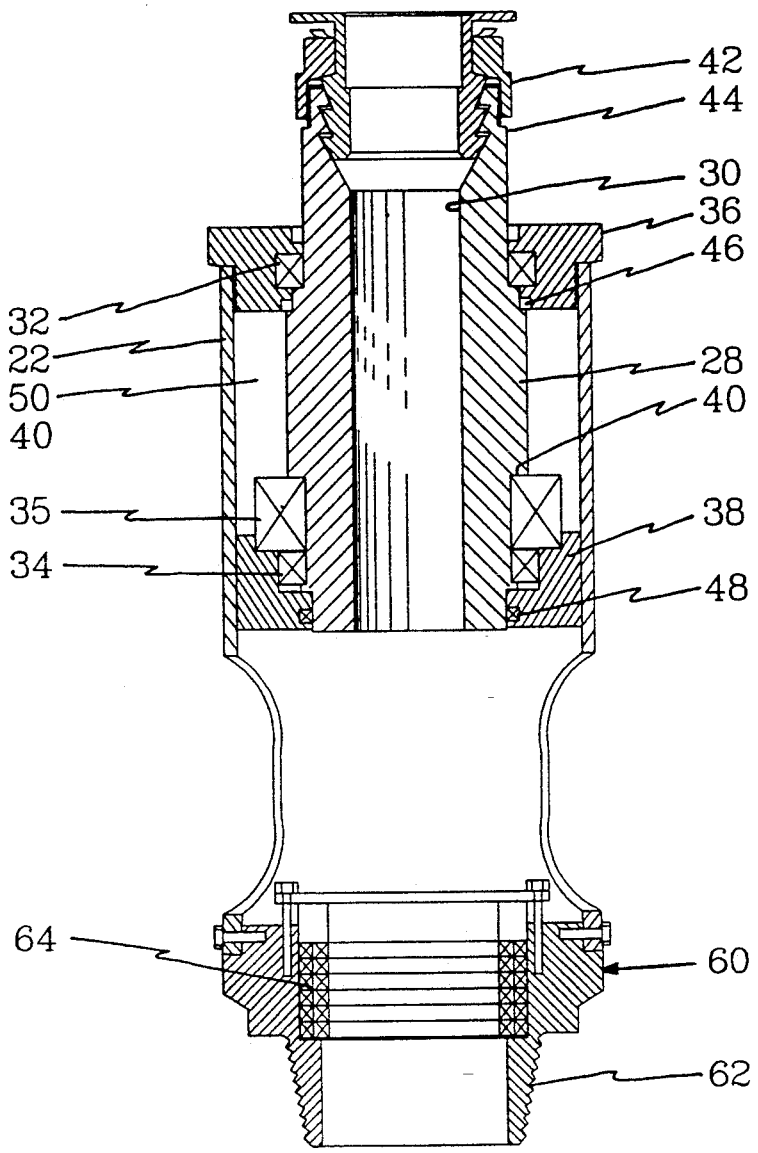
FIG. 2 is a cross-section through the preferred embodiment of a drive head in accordance with the invention.

Turning now to FIG. 2, a preferred drive head in accordance with the invention includes the substantially cylindrical housing 22 and a hollow drive shaft 28 which has an axial bore 30 sized to receive the polished rod 16 (see FIG. 1). The drive shaft 28 is rotatably supported in the housing by upper and lower radial bearings 32, 34, respectively mounted in upper and lower annular bearing mounts 36, 38 which are respectively screwed and welded into the housing 22. The drive shaft 28 has an annular shoulder 40 which rests against an axial thrust bearing 35 mounted on the lower bearing mount 38. The axial thrust bearing 35, supports the weight of the drive shaft 28 and, thus, the drive string suspended therefrom. A chuck arrangement 42 for the clamping of the polished rod in and concentrically with the drive shaft 28 is integral with an upper end 44 of the hollow drive shaft. The construction and function of the chuck arrangement 42 will be described in more detail below in relation to FIGS. 3, 4 and 5. A pair of upper and lower annular seals 46, 48 respectively positioned between the upper and lower bearing mounts 36, 38 and the drive shaft 28 seal a lubricant chamber 50, which is at least partly filled with a lubricating fluid (not shown). A bottom end 60 of the housing 22 has a conventional threaded frustoconical union 62 (NPT or API) for the fastening of the housing to the wellhead assembly 24 (see FIG. 1). The bottom end 60 of the housing 22 also includes a stuffing box 64 for the sealing of the wellhead assembly 24 and the production string 18 around the polished rod 16 (see FIG. 1).

Figure 3:
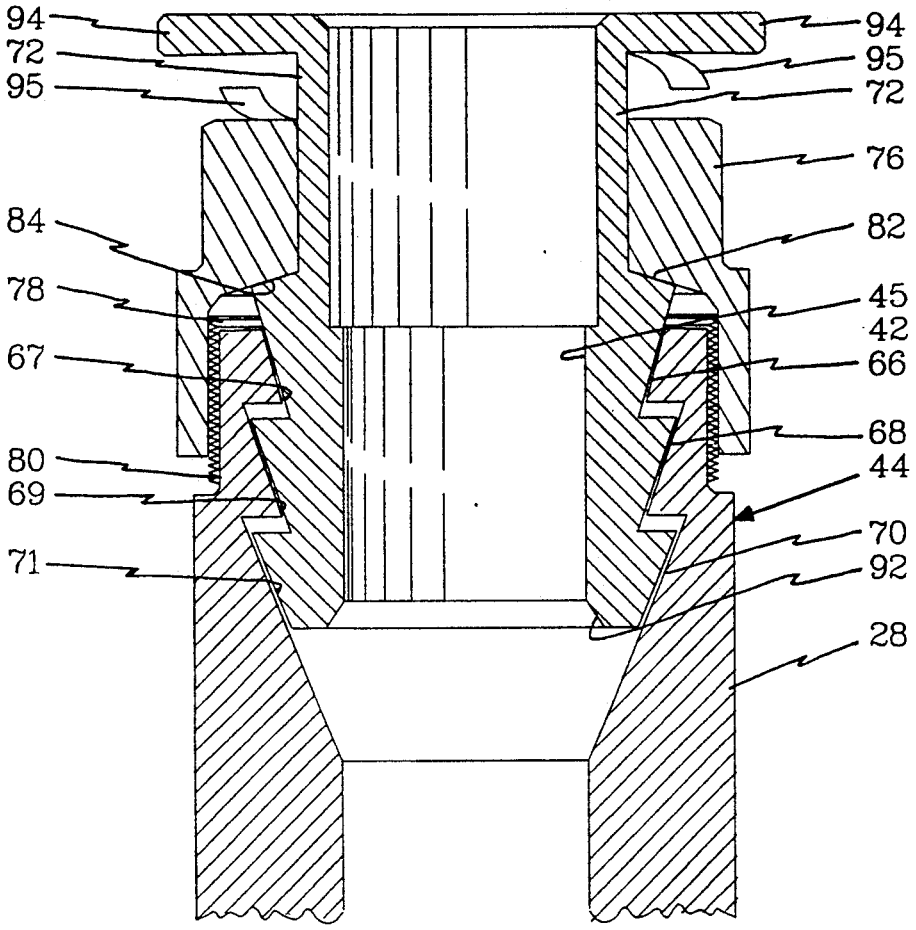
FIG. 3 is an enlarged detail of the drawing in FIG. 2, showing the chuck arrangement.
Figure 4:
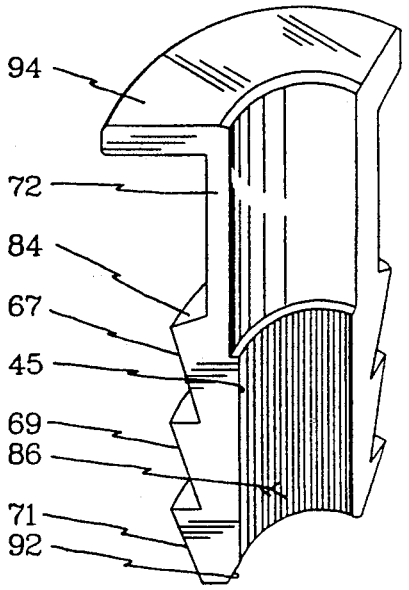
FIG. 4 is an isometric view of a spline of the chuck arrangement shown in FIG. 3.
Figure 5:
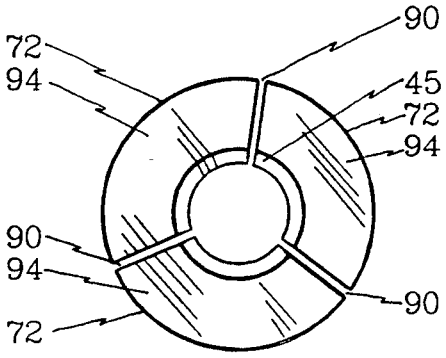
FIG. 5 is a top view of the chuck arrangement shown in FIG. 3.

FIGS. 3, 4 and 5 show the chuck arrangement 42 in more detail. The arrangement is integral with the upper end 44 of the drive shaft 28. The upper end of the shaft includes a set of annular, stepped ramps 58, 70, which each define a frustoconical bore. A number of identical splines 72 (3 in this embodiment as apparent from FIG. 5) are positioned in the upper end 44, which together define a central axial bore 45 for the polished rod 16 (see FIG. 1) and have a corresponding number of outer stepped ramps 67, 69 and 71 of complementary slope so that displacement of the splines 72 in the upper end 44 of the drive shaft 28 will lead to a radial movement of the splines and clamping of the polished rod. A cap 76 has an inner thread 78 for engagement of a complementary threaded section 80 of the drive shaft 28 and has an inner annular shoulder 82. As the cap 76 is screwed onto the drive shaft 28, annular shoulder 82 comes to rest against an outer shoulder 84 of the splines. Further rotation of the cap 76 then forces the splines deeper into the drive shaft 28 along the stepped ramps 66, 68 and 70 and radially inwardly for the clamping of a polished rod (not shown) extending through the chuck arrangement 42. By screwing down cap 76, all splines 72 are moved equally, which means that once the cap is completely tightened, the polished rod 16 is dead centered in the drive shaft which substantially prevents polished rod wobble and the stuffing box leakage resulting therefrom. The threads in the cap 76 and on the end of the drive shaft 28 are left hand threads so that a slippage of the splines 72 relative to the drive shaft will lead to a further tightening of the cap. The splines 72, which each cover a circular section of about 120° around the polished rod 16, have axially extending serrations or teeth 86 (see FIG. 4) on their inner curved surface 88 which comes to rest against a polished rod 16 held in the chuck arrangement 42. As is apparent from FIG. 5, the splines are spaced apart in circumferential direction to allow radial movement, whereby the intermediate gaps 90 narrow when the splines 72 are forced by the cap 76 into the upper end 44 of the drive shaft 28 along the stepped ramps 66, 68 and 70. These ramps are stepped to prevent the splines 72 being pulled out of the chuck arrangement 42 when the polished rod is raised. The splines are provided with a bevelled lower end 92 which facilitates insertion of a polished rod through the chuck arrangement 42 and substantially prevents damage to the polished rod end during insertion. The splines 72 also include a flange portion 94 which prevents the splines falling through the chuck arrangement 42 when no rod is inserted therethrough and provide for easy loosening of the chuck arrangement by unscrewing cap 76 until a wave spring washer 95 positioned between the flange formed by the flange portions 94 of the splines and the cap 76 is compressed which forces the flange portions upward.

The drive head 20 is installed at the wellhead by inserting the polished rod 16 through the drive shaft 28 and sliding the drive head down along the rod until the housing 22 engages the top of wellhead assembly 24. During insertion of the polished rod 16, the weight of the drive string 14 (see FIG. 1) must be supported, for example by using a polished rod clamp and a hoisting apparatus (not shown). To permit insertion of the polished rod 16, the cap 76 of chuck arrangement 42 is almost completely unscrewed, which allows the splines 72 to slide radially outwardly and axially upwardly until the rod can pass therebetween. The housing 22 is then screwed directly to the wellhead assembly 24. The cap 76 is tightened to concentrically clamp the polished rod 16 in the drive shaft 28 and to permit torque transmission from the drive shaft to the rod and, thus, to the drive string 14. This completes the installation of the drive head 20. A conventional polished rod clamp 26 (see FIG. 1) is then installed on the polished rod 16 directly adjacent the upper end 44 of the drive shaft 28. Subsequently, the drive string is released from the hoist or crane (not shown) so that the weight of the drive string is supported by the polished rod clamp 26 which rests on top of the chuck arrangement 42. This completes assembly of the rotatable drive assembly and pumping can begin. The depth of the drive string 14 may be easily adjusted by once again suspending the drive string from a hoist, loosening polished rod clamp 26 and chuck arrangement 42, raising or lowering the drive string as required by way of the hoist, retightening the chuck arrangement and the polished rod clamp and disconnecting the drive string from the hoist.

It will be readily appreciated that certain modifications may be made to the above described preferred embodiments, which would not interfere with their overall function. For example, the upper end 44 of the drive shaft 28 and the splines 72 may be provided with only a single ramp. Furthermore, the pulley-belt combination used for transmitting rotation from the motor to the drive head may be replaced by a sprocket-chain combination or a set of intermeshed gears or any other means which will allow the transmission of torque to the drive shaft 28. Although the preferred number of splines is 3, 2 or more than 3 splines may be used. The serrations 86 are only required for transmission of high torque and may be omitted where a reliable torque transmission without slippage can be achieved without the serrations. However, even if slippage of the polished rod 16 in the chuck arrangement 42 should occur, this would not cause the polished rod to slide down through the chuck arrangement, since the weight of the drive string is not suspended from the chuck arrangement but from the polished rod clamp 26. The chuck arrangement 42 may further include set screws (not shown) which radially extend through the end 44 of the drive shaft 28 and engage the splines 72 to prevent slippage of the splines in the drive shaft. The threads in the cap 76 and on the drive shaft 28 could be right hand threads, although left hand threads are preferred. The chuck arrangement 42 need not be integral with an end portion of the drive shaft 28, but can be positioned intermediate the shaft ends as long as the splines 72 can be axially moved in the drive shaft 28 along the stepped ramps 66, 68 and 70 to reliably clamp and center the polished rod 16 to prevent wobble and stuffing box leakage. Means for suspending the weight of the drive string other than a polished rod clamp may also be used as long as they reliably prevent downward polished rod slippage. Finally, the drive head may include separate centering means such as a set of conical thrust bearings mounted in the shaft and on the polished rod, and means for transmitting torque, such as a conventional pipe clamping arrangement keyed to the drive shaft.

Changes and modifications in the specifically described embodiments can be carried out without departing from the scope of the invention which is intended to be limited only by the scope of the appended claims.

I claim:

1. A drive head for a downhole rotary pump operated by a drive string rotatable in a production string, comprising a rotatable drive shaft having an axis and an axial bore for receiving a portion of the drive string;

mount means for rotatably supporting the drive shaft on an coaxial with a wellhead assembly, the drive shaft being rotatable around the axis;

drive means for rotating the drive shaft relative to the mount means;

means for transmitting torque from the drive shaft to the portion of the drive string; and means for centering the portion of the drive string in the drive shaft, the means for transmitting torque and the means for centering being combined in a clamping means integral with the drive shaft for concentrically clamping the portion of the drive string in the drive shaft and to permit transmission of torque from the drive shaft to the drive string.

2. A drive head as defined in claim 1, wherein the mount means includes a housing attachable to the wellhead assembly, and a bearing means for rotatably supporting the drive shaft in the housing.

3. A drive head as defined in claim 2, wherein the drive shaft is a spindle.

4. A drive head as defined in claim 2, wherein the portion of the drive string is a polished rod.

5. A drive head as defined in claim 3, wherein the drive head further includes a stuffing box for sealing the wellhead assembly around the drive string.

6. A drive head as defined in claim 1, wherein the clamping means is a chuck arrangement for concentrically clamping the portion of the drive string in the drive shaft.

7. A drive head as defined in claim 6, wherein the chuck arrangement is integral with a portion of the drive shaft having a frustoconical bore and the chuck arrangement includes spline means for gripping the portion of the drive string, the spline means having an outer frustoconical surface complementary in slope to the frustoconical bore and defining an axial bore for receiving the drive string, and a means for axially forcing the spline means into the frustoconical bore, whereby the spline means is radially inwardly forced against the portion of the drive string extending through the axial bore defined by the spline means for clamping the drive string.

8. A drive head as defined in claim 6 or 7, wherein the chuck arrangement is integral with an end portion of the shaft remote from the wellhead assembly, the spline means has an outer annular shoulder, the means for forcing is a cap having a bore for the drive string, the bore including a threaded portion for engaging an outer thread on the end portion of the drive shaft and an annular shoulder for resting against the outer annular shoulder of the spline means, and the spline means is forced into the frustoconical bore when the cap is screwed onto the end portion.

9. A drive head as defined in claim 8, wherein the threaded portion of the bore and the end portion of the drive shaft have left-hand threads so that slippage of the portion of the drive string in the chuck arrangement will lead to further tightening of the cap.

10. A drive head as defined in claim 8, wherein the spline means consists of at least three individual splines.

11. A drive head as defined in claim 10, wherein the cap has a hexagonal shape.

12. A rotary drive assembly for a rotary downhole pump operated by a drive string rotatable in the production string, comprising a drive head as defined in claim 1, 6, or 7 for rotating the drive string in the production string; and means for suspending the weight of the drive string from the drive head.

13. A rotary drive assembly for a rotary downhole pump operated by a drive string rotatable in the production string, comprising a drive head as defined in claim 2, for rotating the drive string in the production string; and means for suspending the weight of the drive string from the drive head.

14. A rotary drive assembly for a rotary downhole pump operated by a drive string rotatable in the production string, comprising a drive head as defined in claim 8, for rotating the drive string in the production string; and means for suspending the weight of the drive string from the drive head.

15. A rotary drive assembly as defined in claim 12, wherein the means for suspending is a polished rod clamp resting on the drive shaft.

16. A rotary drive assembly as defined in claim 13, wherein the means for suspending is a polished rod clamp resting on the drive shaft.

17. A rotary drive assembly as defined in claim 14, wherein the means for suspending is a polished rod clamp resting on the drive shaft.

* * * * *